US010626859B2

(12) United States Patent
Ki et al.

(10) Patent No.: US 10,626,859 B2
(45) Date of Patent: Apr. 21, 2020

(54) LINEAR COMPRESSOR AND REFRIGERATOR INCLUDING A LINEAR COMPRESSOR

(71) Applicant: LG ELECTRONICS INC., Seoul (KR)

(72) Inventors: Sunghyun Ki, Seoul (KR); Gyeoungjin Jeon, Seoul (KR); Changkyu Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/897,196

(22) Filed: Feb. 15, 2018

(65) Prior Publication Data

US 2018/0171994 A1 Jun. 21, 2018

Related U.S. Application Data

(63) Continuation of application No. 14/676,935, filed on Apr. 2, 2015.

(30) Foreign Application Priority Data

Jul. 16, 2014 (KR) ..... 10-2014-0089630

(51) Int. Cl.
*F04B 35/04* (2006.01)
*F04B 39/00* (2006.01)
(Continued)

(52) U.S. Cl.
CPC ..... *F04B 35/045* (2013.01); *F04B 39/0044* (2013.01); *F04B 39/121* (2013.01);
(Continued)

(58) Field of Classification Search
CPC .... F04B 17/04; F04B 39/0044; F04B 39/127; F04B 53/003; F04B 35/04–045; F04B 39/14; F04B 53/22
(Continued)

(56) References Cited

U.S. PATENT DOCUMENTS 3,031,861 A 5/1962 McCormack
3,317,166 A * 5/1967 Janssen ..... F16F 15/02 248/604
(Continued)

FOREIGN PATENT DOCUMENTS

CN 101205888 6/2008
CN 101265895 9/2008
(Continued)

OTHER PUBLICATIONS

European Search Report dated Dec. 4, 2015.
(Continued)

*Primary Examiner* — Alexander B Comley
(74) *Attorney, Agent, or Firm* — Ked & Associates LLP

(57) ABSTRACT

A linear compressor and a refrigerator including a linear compressor are provided. The linear compressor may include a compressor casing connected to each of a suction inlet, through which a refrigerant may be introduced, and a discharge outlet, through which the refrigerant may be discharged, a compressor body mounted within the compressor casing, within which the refrigerant suctioned in through the suction inlet may be compressed due to a linear reciprocating motion of a piston in an axial direction of the compressor casing and discharged into the discharge outlet, and at least one plate spring disposed on each end of the compressor body in the axial direction.

6 Claims, 5 Drawing Sheets

(51) Int. Cl.

| | |
|---|---|
| ***F04B 39/12*** | (2006.01) |
| ***F04B 53/00*** | (2006.01) |
| ***F04B 39/14*** | (2006.01) |
| ***F04B 53/22*** | (2006.01) |

(52) U.S. Cl.
CPC ..... *F04B 39/127* (2013.01); *F04B 53/003* (2013.01); *F04B 39/14* (2013.01); *F04B 53/22* (2013.01)

(58) Field of Classification Search
USPC ..... 417/417
See application file for complete search history.

(56) References Cited

U.S. PATENT DOCUMENTS

| | | | | |
|---|---|---|---|---|
| 2002/0057974 | A1 | 5/2002 | Toyama et al. | |
| 2002/0155741 | A1 | 10/2002 | Herrick et al. | |
| 2005/0135946 | A1* | 6/2005 | Kang | F04B 35/045 417/416 |
| 2005/0158193 | A1* | 7/2005 | Roke | F04B 35/045 417/417 |
| 2005/0214140 | A1* | 9/2005 | Lee | F04B 35/045 417/416 |
| 2009/0202373 | A1 | 8/2009 | Williams | |
| 2012/0177513 | A1* | 7/2012 | Lilie | F04B 35/045 417/417 |
| 2013/0247608 | A1 | 9/2013 | Hiratsuka | |

FOREIGN PATENT DOCUMENTS

| | | |
|---|---|---|
| CN | 100538068 | 9/2009 |
| CN | 103731003 | 4/2014 |
| DE | 10 2005 038 780 | 2/2007 |
| EP | 1 002 952 | 5/2000 |
| EP | 2 072 822 | 6/2009 |
| EP | 2 568 586 | 3/2013 |
| GB | 1222425 | 2/1971 |
| JP | 11-2468 | 1/1999 |
| JP | 11-173694 | 7/1999 |
| KR | 10-1307688 | 9/2013 |
| WO | WO 00/70223 | 11/2000 |
| WO | WO 2007/011247 | 1/2007 |
| WO | WO 2015/099306 | 7/2015 |

OTHER PUBLICATIONS

Chinese Office Action dated Jul. 11, 2017.
Chinese Office Action dated Dec. 28, 2017 (English Translation).
U.S. Office Action issued in U.S. Appl. No. 14/676,935 dated Apr. 18, 2017.
Final U.S. Office Action issued in U.S. Appl. No. 14/676,935 dated Sep. 26, 2017.
European Search Report dared Jul. 25, 2018.

* cited by examiner

LINEAR COMPRESSOR AND REFRIGERATOR INCLUDING A LINEAR COMPRESSOR

CROSS-REFERENCE TO RELATED APPLICATIONS

This application is a Continuation Application of prior U.S. patent application Ser. No. 14/676,935 filed on Apr. 2, 2015, which claims priority under 35 U.S.C. § 119 to Korean Application No. 10-2014-0089630, filed in Korea on Jul. 16, 2014, whose entire disclosures are hereby incorporated by reference.

BACKGROUND

1. Field

A linear compressor and a refrigerator including a linear compressor are disclosed herein.

2. Background

In general, compressors are machines that receive power from a power generation device, such as an electric motor or turbine, to compress air, a refrigerant, or various working gases, thereby increasing in pressure. Compressors are being widely used in home appliances, such as refrigerators or air conditioners, or industrial fields.

Compressors may be largely classified into reciprocating compressors, in which a compression space into and from which a working gas is suctioned and discharged, is defined between a piston and a cylinder to allow the piston to be linearly reciprocated in the cylinder, thereby compressing the working gas; rotary compressors, in which a compression space into and from which a working gas is suctioned and discharged, is defined between a roller that eccentrically rotates and a cylinder to allow the roller to eccentrically rotate along an inner wall of the cylinder, thereby compressing the working gas; and scroll compressors, in which a compression space into and from which a working gas is suctioned and discharged, is defined between an orbiting scroll and a fixed scroll to compress the working gas while the orbiting scroll rotates along the fixed scroll. In recent years, a linear compressor, which is directly connected to a drive motor and in which a piston is linearly reciprocated, to improve compression efficiency without mechanical losses due to movement conversion and having a simple structure, is being widely developed.

The linear compressor according to the related art is disclosed in Korean Patent Application No. 10-1307688, the disclosure of which is hereby incorporated by reference. The linear compressor includes a sealed compressor casing and a compressor body mounted inside the compressor casing to accommodate compressor-related components, such as a piston, a cylinder, and a linear motor. The linear compressor may suction and compress a refrigerant while a piston is linearly reciprocated within the cylinder by a linear motor and then discharge the refrigerant. The linear motor is configured to allow a permanent magnet to be disposed between an inner stator and an outer stator. The permanent magnet may be linearly reciprocated by an electromagnetic force between the permanent magnet and the inner (or outer) stator. As the permanent magnet operates in a state in which the permanent magnet is connected to the piston, the refrigerant may be suctioned and compressed while the piston is linearly reciprocated within the cylinder and then discharged.

The linear compressor includes a body support including four coil springs to support the compressor body within the compressor casing. The four coil springs are coupled to the compressor body and mounted on a bottom, that is, perpendicular to an axial direction of the compressor casing. In a case of the body support, the body support may have low rigidity in a moving direction of the compressor body, which is the axial direction of the compressor casing, that is, low longitudinal rigidity to improve vibration insulation. On the other hand, the body support may have high rigidity in a direction perpendicular to the axial direction of the compressor casing, that is, high transverse rigidity to prevent the compressor casing from colliding with the compressor body. As a result, the linear compressor may include the body support having low longitudinal rigidity and high transverse rigidity. Due to slimness trends in recent years, it is a trend to manufacture linear compressors having a slimmer thickness. However, in the linear compressor according to the related art, the compressor body may be mounted to be spaced a predetermined distance or more (generally, about 10 mm or more) from an inner wall of the compressor casing within the compressor casing to prevent the compressor casing from colliding with the compressor body due to general characteristics of the coil spring having longitudinal rigidity and transverse rigidity, which are proportional to each other.

Thus, the linear compressor may have a limitation in that the compressor casing increases in size to secure the required spaced distance. Also, in the linear compressor according to the related art, an additional space to mount the body support within the compressor casing is needed due to the four coil spring of the body support, that is, mounted on the bottom of the compressor casing. As a result, the compressor casing may increase in size.

BRIEF DESCRIPTION OF THE DRAWINGS

Embodiments will be described in detail with reference to the following drawings in which like reference numerals refer to like elements, and wherein.

DETAILED DESCRIPTION

Embodiments will be described below in more detail with reference to the accompanying drawings. The description is intended to be illustrative, and those with ordinary skill in the technical field pertains will understand that embodiments may be carried out in other specific forms without changing the technical idea or essential features. Also, for helping understanding, the drawings are not to actual scale, but are partially exaggerated in size.

Figure 1:
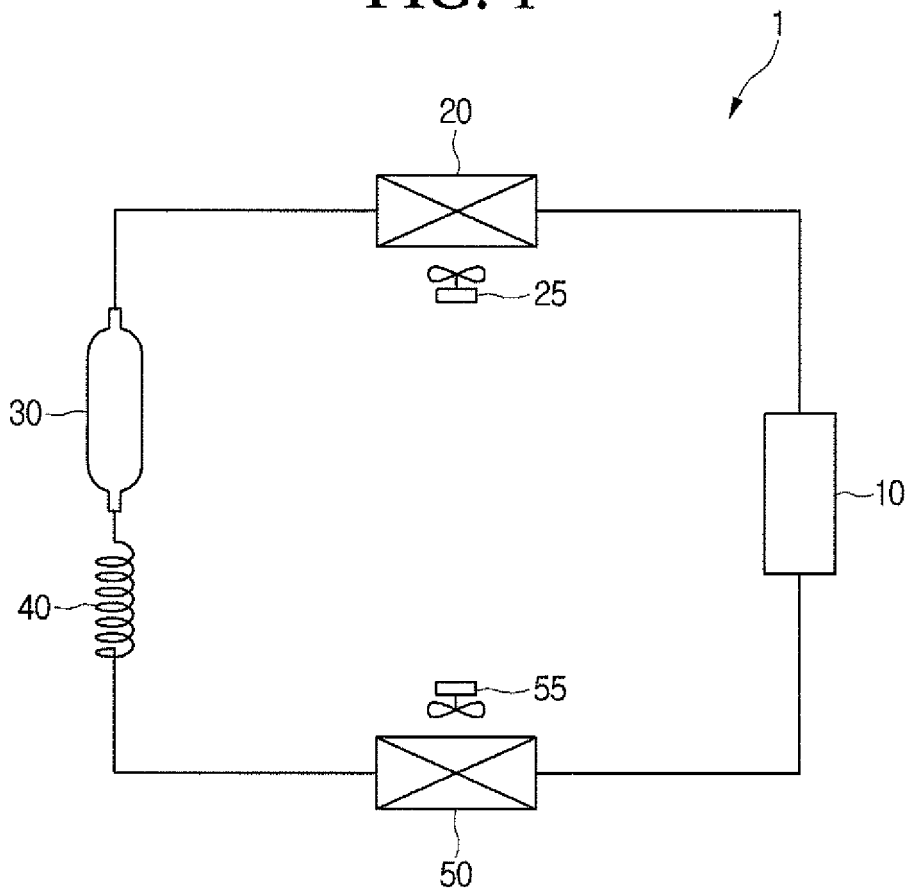
FIG. 1 is a schematic diagram of a refrigerator according to an embodiment.

FIG. 1 is a schematic diagram of a refrigerator according to an embodiment. Referring to FIG. 1, a refrigerator 1 according to an embodiment may include a plurality of devices for driving a refrigeration cycle.

In detail, the refrigerator 1 may include a compressor 10 to compress a refrigerant, a condenser 20 to condense the refrigerant compressed in the compressor 10, a dryer 30 to remove moisture, foreign substances, or oil from the refrigerant condensed in the condenser 20, an expansion device 40 to decompress the refrigerant passing through the dryer 30, and an evaporator 50 to evaporate the refrigerant decompressed in the expansion device 40. The refrigerator 1 may further include a condensation fan 25 to blow air toward the condenser 20, and an evaporation fan 55 to blow air toward the evaporator 50.

The compressor 10 may include a linear compressor that linearly reciprocates a piston directly connected to a motor within a cylinder to compress the refrigerant. Hereinafter, the compressor according to this embodiment may refer to a linear compressor. The linear compressor 10 will be described in detail with reference to FIGS. 3 to 7.

The expansion device 40 may include a capillary tube having a relatively small diameter. A liquid refrigerant condensed in the condenser 20 may be introduced into the dryer 30. A gaseous refrigerant may be partially contained in the liquid refrigerant. A filter to filter the liquid refrigerant introduced into the dryer 30 may be provided in the dryer 30.

Figure 2:
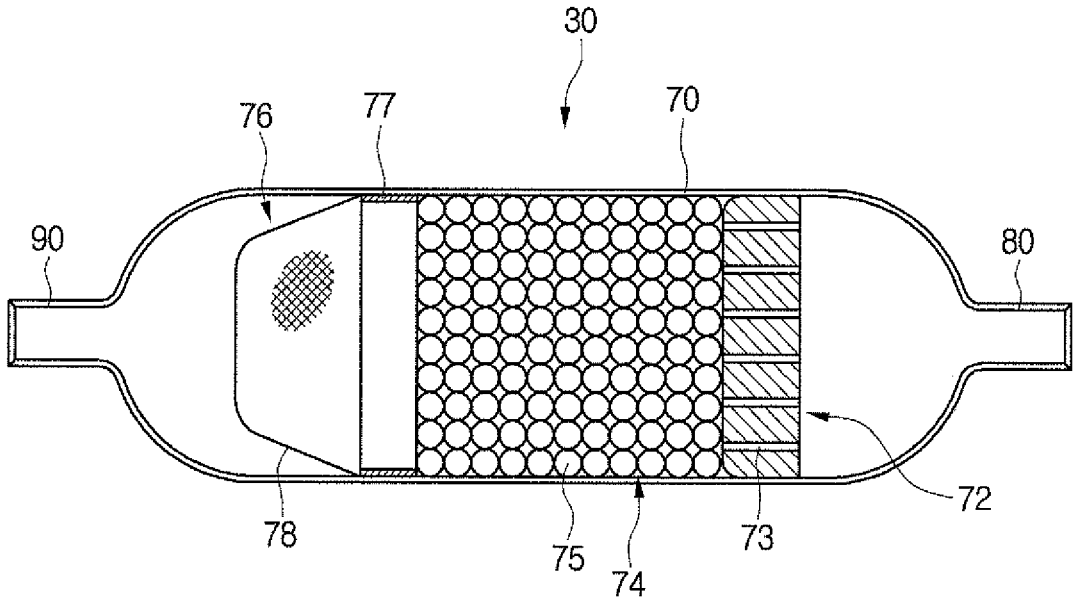
FIG. 2 is a view of a dryer of the refrigerator of FIG. 1.

FIG. 2 is a view of a dryer of the refrigerator of FIG. 1. Referring to FIG. 2, the dryer 30 may include a dryer body 70 that defines a flow space of the refrigerant, a refrigerant inflow 80 disposed on or at a first side of the dryer body 70 to guide introduction of the refrigerant, and a refrigerant discharge 90 disposed on or at a second side of the dryer body 70 to guide discharge of the refrigerant.

The dryer body 70 may have a long cylindrical shape, for example. Dryer filters 72, 74, and 76 may be provided in the dryer body 70.

In detail, the dryer filters 72, 74, and 76 may include a first dryer filter 72 disposed adjacent to the refrigerant inflow 80, a third dryer filter 76 spaced apart from the first dryer filter 72 and disposed adjacent to the refrigerant discharge 80, and a second dryer filter 74 disposed between the first dryer filter 72 and the third dryer filter 76. The first dryer filter 72 may be disposed adjacent to an inside of the refrigerant inflow 80, that is, disposed at a position closer to the refrigerant inflow 80 than the refrigerant discharge 90.

The first dryer filter 72 may have an approximately hemispherical shape. An outer circumferential surface of the first dryer filter 72 may be coupled to an inner circumferential surface of the dryer body 70. A plurality of through holes 73 to guide flow of the refrigerant may be defined in the first dryer filer 72. A foreign substance having a relatively large volume may be filtered by the first dryer filter 72.

The second dryer filter 74 may include a plurality of adsorbents 75. Each of the plurality of adsorbents 75 may be a grain having a predetermined size. Each adsorbent 75 may be a molecular sieve and have a predetermined size of about 5 mm to about 10 mm.

A plurality of holes may be defined in each adsorbent 75. Each of the plurality of holes may have a size similar to that of oil (about 10 Å). The hole may have a size greater than a size (about 2.8 Å to about 3.2 Å) of the moisture, and a size (about 4.0 Å in case of R134a, and about 4.3 Å in case of R600a) of the refrigerant. The term "oil" may refer to working oil or cutting oil injected when components of the refrigeration cycle are manufactured or processed.

The refrigerant and moisture passing through the first dryer filter 72 may be easily discharged therethrough, even though the refrigerant and moisture are easily introduced into the plurality of holes while passing through the plurality of adsorbents 75. Thus, the refrigerant and moisture may not be easily adsorbed onto or into the plurality of adsorbents 75. However, if the oil is introduced into the plurality of holes, the oil may not be easily discharged, and thus, may be maintained in a state in which the oil is adsorbed onto or into the plurality of adsorbents 75.

For example, each adsorbent 75 may include a BASF 13X molecular sieve. A hole defined in the BASF 13X molecular sieve may have a size of about 10 Å (1 nm), and the BASF 13X molecular sieve may be expressed as a chemical formula:

$$Na_2O.Al_2O_3.mSiO_2.nH_2O \ (m \leq 2.35).$$

The oil contained in the refrigerant may be adsorbed onto or into the plurality of adsorbents 75 while passing through the second dryer filter 74.

Alternatively, the second dryer filter 74 may include an oil adsorbent paper or an adsorbent including a felt, instead of the plurality of adsorbents, each of which has a grain shape.

The third dryer filter 76 may include a coupling portion 77 coupled to an inner circumferential surface of the dryer body 70, and a mesh 78 that extends from the coupling portion 77 toward the refrigerant discharge 90. The third dryer filer 76 may be referred to as a mesh filter. A foreign substance having a fine size contained in the refrigerant may be filtered by the mesh 78.

Each of the first dryer filter 72 and the third dryer filter 76 may serve as a support to locate or position the plurality of adsorbents 75 within the dryer body 70. That is, discharge of the plurality of adsorbents 75 from the dryer 20 may be restricted by the first and third dryer filters 72 and 76.

As described above, the filters may be provided in the dryer 20 to remove foreign substances or oil contained in the refrigerant, thereby improving reliability of refrigerant which acts as a gas bearing.

Hereinafter, the linear compressor 10 according to an embodiment will be described in detail.

Figure 3:
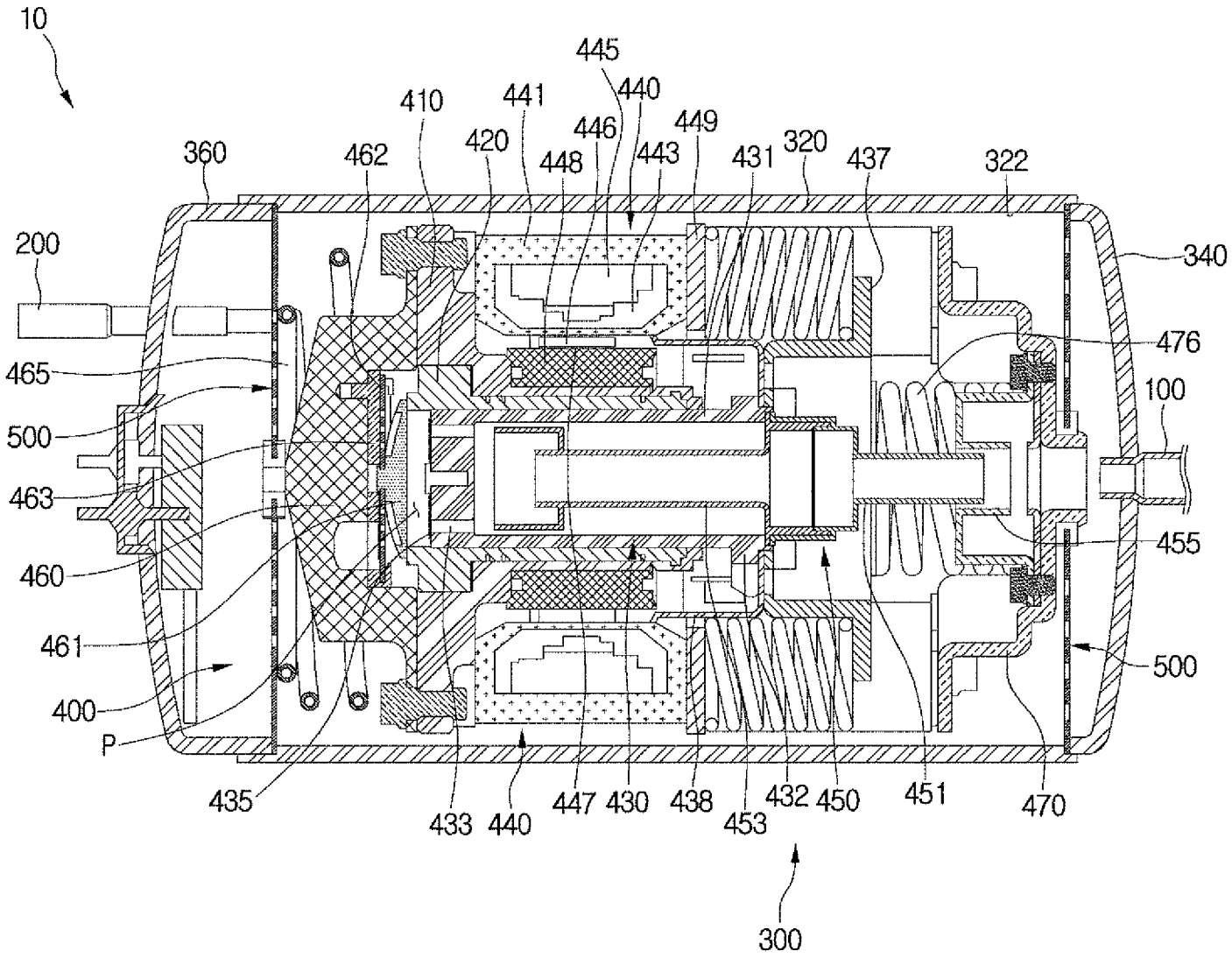
FIG. 3 is a cross-sectional view of a linear compressor of the refrigerator of FIG. 1.
Figure 4:
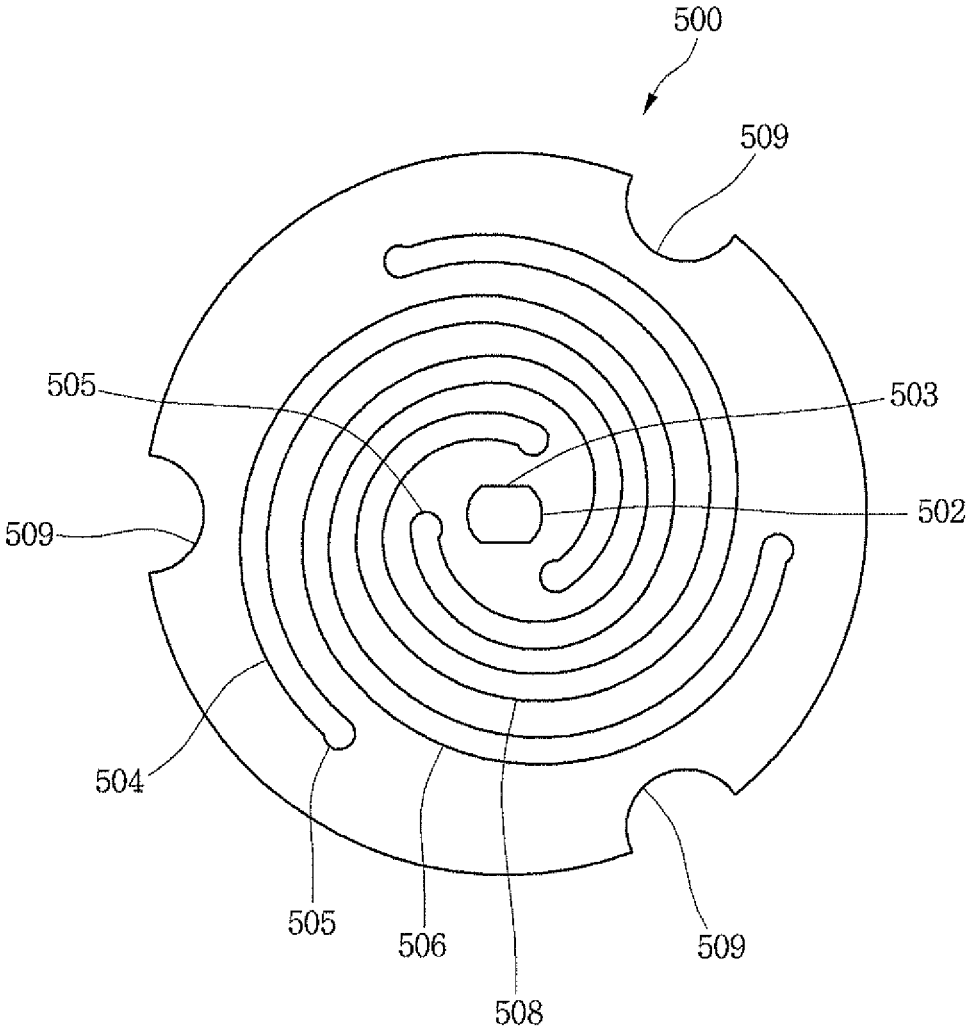
FIG. 4 is a plan view of a body support of the linear compressor of FIG. 3.
Figure 5:
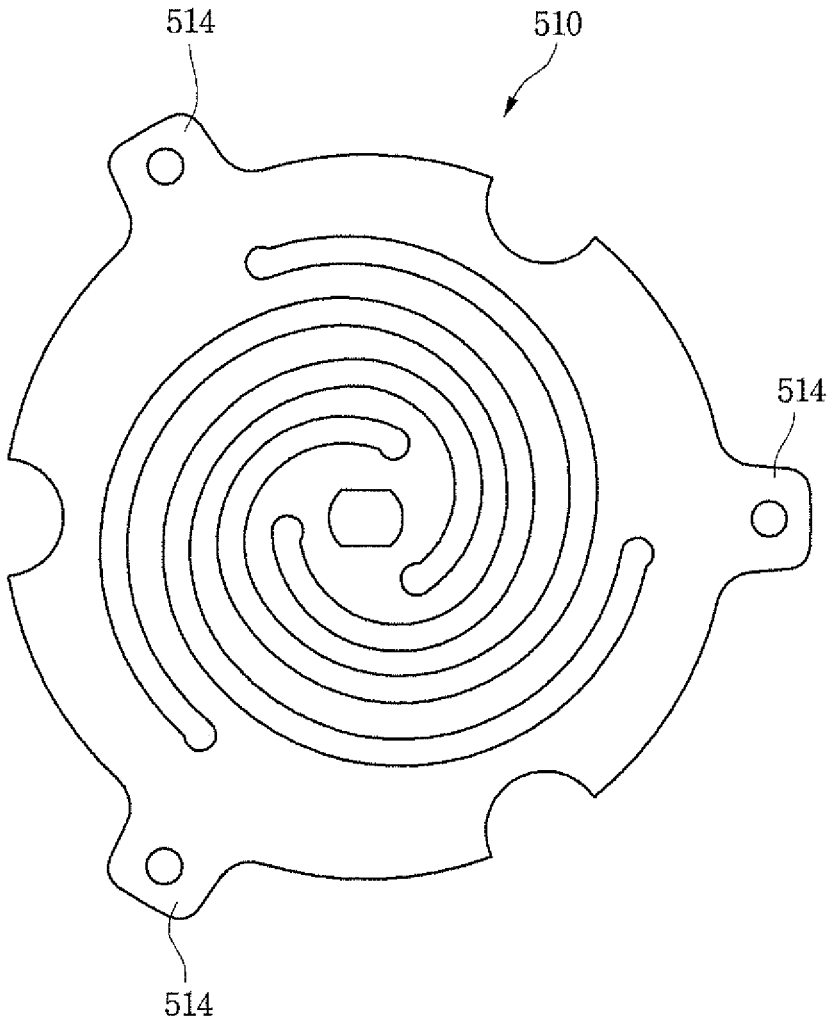
FIG. 5 is a plan view of a body support according to another embodiment.
Figure 6:
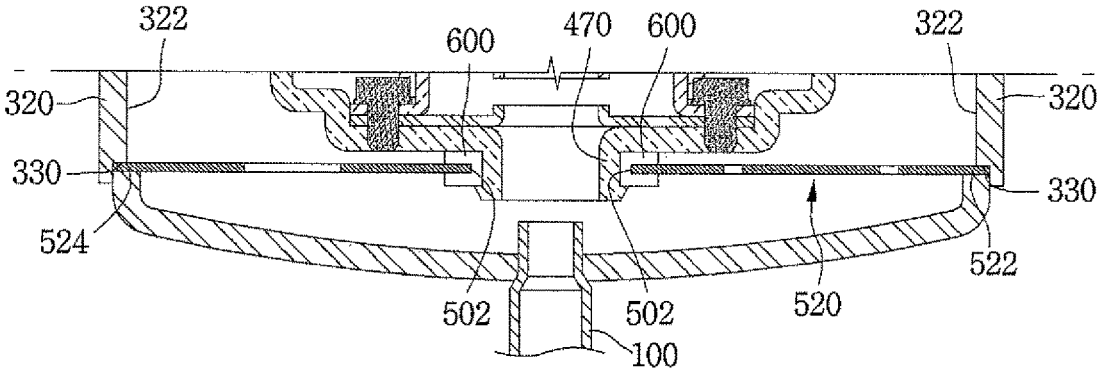
FIGS. 6 and 7 are views for explaining a main component of the linear compressor of FIG. 3.
Figure 7:
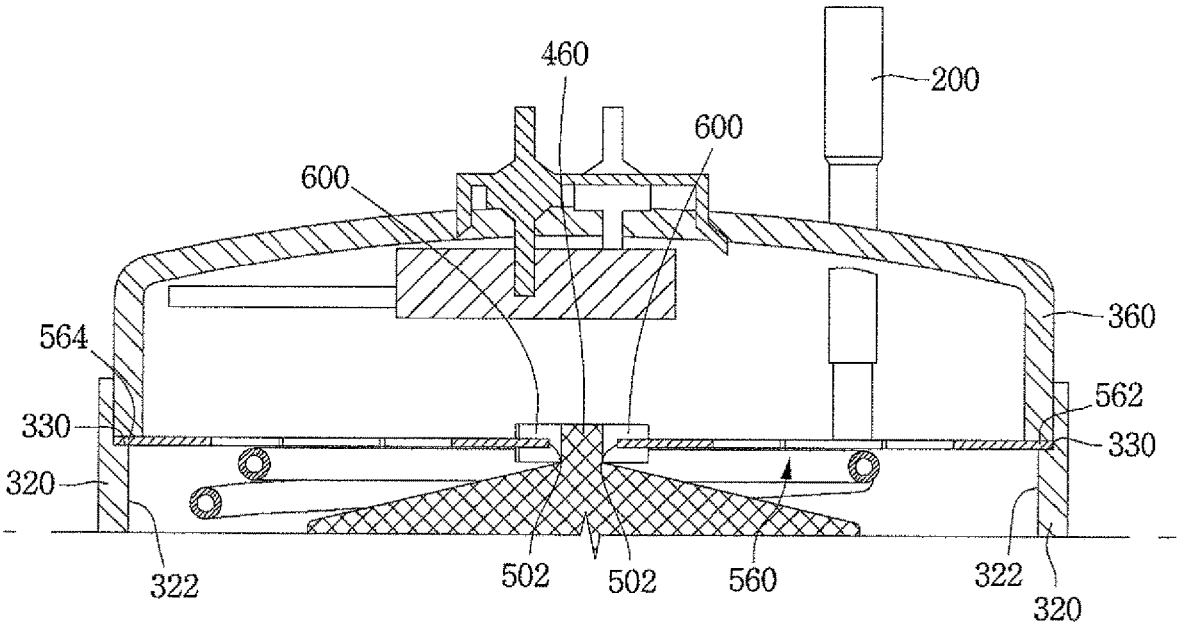

FIG. 3 is a cross-sectional view of a linear compressor of the refrigerator of FIG. 1. FIG. 4 is a plan view of a body support of the linear compressor of FIG. 3. FIG. 5 is a plan view of a body support according to another embodiment. FIGS. 6 and 7 are views for explaining a main component of the linear compressor of FIG. 3.

Referring to FIGS. 3 to 7, the linear compressor 10 may include a suction inlet 100, a discharge outlet 200, a compressor casing 300, a compressor body 400, and one or more body support 500. The suction inlet 100 may introduce refrigerant into the compressor body 400 and may be mounted to pass through a first cover 340 of the compressor casing 300, which will be described hereinbelow. The discharge outlet 200 may discharge the compressed refrigerant from the compressor body 400 and may be mounted to pass through a second cover 360 of the compressor casing 300, which will be described hereinbelow.

The compressor casing 300 may accommodate the compressor body 400 and include a base shell 320, the first cover 340, and the second cover 360. The base shell 320 may accommodate the compressor body 400 therein. The base shell 320 may have an approximately cylindrical shape. The base shell 320 may define an exterior of the linear compressor 10, in particular, a lateral exterior of the linear compressor 10. The base shell 320 may have a thickness of about 2 T.

The first cover 340 may be mounted at a first side of the base shell 320. In this embodiment, the first cover 340 may be mounted on a right or first lateral side of the base shell 320. The suction inlet 100 may pass through the first cover 340 to introduce the refrigerant into the compressor body 400.

The second cover 360 may be mounted on a second side of the base shell 320. In this embodiment, the second cover 360 may be mounted on a left or second lateral side of the base shell 320, which is opposite to the first cover 340. The discharge outlet 200 may pass through the second cover 360 to discharge the compressed refrigerant.

The compressor body 400 may compress the refrigerant introduced through the suction inlet 100 and discharge the compressed refrigerant through the discharge outlet 200. The compressor body 400 may include a cylinder 420 provided in the base shell 320, a piston 430 linearly reciprocated within the cylinder 420, and a motor assembly 440, that is, a linear motor to apply a drive force to the piston 430.

The compressor body 400 may further include a suction muffler 450. The refrigerant suctioned in through the suction inlet 100 may flow into the piston 430 via the suction muffler 450. Thus, while the refrigerant passes through the suction muffler 450, noise may be reduced. The suction muffler 450 may be formed by coupling a first muffler 451 to a second muffler 453. At least one portion of the suction muffler 450 may be disposed within the piston 430.

The piston 430 may include a piston body 431 having an approximately cylindrical shape, and a piston flange 432 that extends from the piston body 431 in a radial direction. The piston body 431 may be reciprocated within the cylinder 420, and the piston flange 432 may be reciprocated outside of the cylinder 420.

The piston 430 may be formed of a non-magnetic material, such as an aluminum material, such as aluminum or an aluminum alloy. As the piston 430 is formed of the aluminum material, a magnetic flux generated in the motor assembly 440 may not be transmitted into the piston 430, and thus, may be prevented from leaking outside of the piston 430. The piston 430 may be manufactured by a forging process, for example.

The cylinder 420 may be formed of a non-magnetic material, such as an aluminum material, such as aluminum or an aluminum alloy. The cylinder 420 and the piston 430 may have a same material composition, that is, a same kind and composition.

As the cylinder 420 may be formed of an aluminum material, a magnetic flux generated in the motor assembly 440 may not be transmitted into the cylinder 420, and thus, may be prevented from leaking outside of the cylinder 420. The cylinder 420 may be manufactured by an extruding rod processing process, for example.

As the piston 430 may be formed of the same material (aluminum) as the cylinder 420, the piston 430 may have a same thermal expansion coefficient as the cylinder 420. When the linear compressor 10 operates, a high-temperature (a temperature of about 100° C.) environment may be created within the compressor casing 300. Thus, as the piston 430 and the cylinder 420 may have the same thermal expansion coefficient, the piston 430 and the cylinder 420 may be thermally deformed by a same degree. As a result, the piston 430 and the cylinder 420 may be thermally deformed with sizes and in directions different from each other to prevent the piston 430 from interfering with the cylinder 420 while the piston 430 moves.

The cylinder 420 may accommodate at least a portion of the suction muffler 450 and at least a portion of the piston 430. The cylinder 420 may have a compression space P, in which the refrigerant may be compressed by the piston 430. A suction hole 433, through which the refrigerant may be introduced into the compression space P, may be defined in or at a front portion of the piston 430, and a suction valve 435 to selectively open the suction hole 433 may be disposed on a front side of the suction hole 433. A coupling hole, to which a predetermined coupling member may be coupled, may be defined in an approximately central portion of the suction valve 435.

A discharge cover 460 that defines a discharge space or discharge passage for the refrigerant discharged from the compression space P and a discharge valve assembly 461, 462, and 463 coupled to the discharge cover 460 to selectively discharge the refrigerant compressed in the compression space P may be provided at a front side of the compression space P. The discharge valve assembly 461, 462, and 463 may include a discharge valve 461 to introduce the refrigerant into the discharge space of the discharge cover 460 when a pressure within the compression space P is above a predetermined discharge pressure, a valve spring 462 disposed between the discharge valve 461 and the discharge cover 460 to apply an elastic force in an axial direction, and a stopper 463 to restrict deformation of the valve spring 462. The term compression space P may refer to a space defined between the suction valve 435 and the discharge valve 461.

The term "axial direction" may refer to a direction in which the piston 530 is reciprocated, that is, a transverse direction in FIG. 3. Also, in the axial direction, a direction from the suction inlet 100 toward the discharge outlet 200, that is, a direction in which the refrigerant flows, may be referred to as a "frontward direction", and a direction opposite to the frontward direction may be referred to as a "rearward direction". On the other hand, the term "radial direction" may refer to a direction perpendicular to the direction in which the piston 430 is reciprocated, that is, a horizontal direction in FIG. 3.

The stopper 463 may be seated on the discharge cover 460, and the valve spring 462 may be seated at a rear side of the stopper 463. The discharge valve 461 may be coupled to the valve spring 462, and a rear portion or rear surface of the discharge valve 461 may be supported by a front surface of the cylinder 420. For example, the valve spring 462 may include a plate spring.

The suction valve 435 may be disposed on or at one or a first side of the compression space P, and the discharge valve 461 maybe disposed on or at the other or a second side of the compression space P, that is, a side opposite of the suction valve 435.

While the piston 430 is linearly reciprocated within the cylinder 420, when the pressure of the compression space P is below the predetermined discharge pressure and a predetermined suction pressure, the suction valve 435 may be opened to suction the refrigerant into the compression space P. On the other hand, when the pressure of the compression space P is above the predetermined suction pressure, the refrigerant may be compressed in the compression space P in a state in which the suction valve 435 is closed.

When the pressure of the compression space P is above the predetermined discharge pressure, the valve spring 462 may be deformed to open the discharge valve 461. The refrigerant may be discharged from the compression space P into the discharge space of the discharge cover 460.

The refrigerant flowing into the discharge space of the discharge cover 460 may be introduced into a loop pipe 465. The loop pipe 465 may be coupled to the discharge cover 460 to extend to the discharge outlet 200, thereby guiding the compressed refrigerant in the discharge space into the discharge outlet 200. For example, the loop pipe 465 may have a shape which is wound in a predetermined direction and extends in a rounded shape. The loop pipe 465 may be coupled to the discharge outlet 200.

The compressor body 400 may further include a frame 410. The frame 410 may fix the cylinder 420 and be coupled to the cylinder 420 by a separate coupling member, for example. The frame 410 may be disposed to surround the cylinder 420. That is, the cylinder 420 may be accommodated within the frame 410. The discharge cover 460 may be coupled to a front surface of the frame 410.

At least a portion of the high-pressure gaseous refrigerant discharged through the open discharge valve 461 may flow toward an outer circumferential surface of the cylinder 420 through a space formed at a portion at which the cylinder 420 and the frame 410 are coupled to each other. The refrigerant may be introduced into the cylinder 420 through a gas inflow and a nozzle, which may be defined in the cylinder 420. The introduced refrigerant may flow into a space defined between the piston 430 and the cylinder 420 to allow an outer circumferential surface of the piston 430 to be spaced apart from an inner circumferential surface of the cylinder 420. Thus, the introduced refrigerant may serve as a "gas bearing" that reduces friction between the piston 430 and the cylinder 420 while the piston 200 is reciprocated.

The motor assembly 440 may include outer stators 441, 443, and 445 fixed to the frame 410 and disposed to surround the cylinder 420, an inner stator 448 disposed to be spaced inward from the outer stators 441, 443, and 445, and a permanent magnet 446 disposed in a space between the outer stators 441, 443, and 445 and the inner stator 148. The permanent magnet 446 may be linearly reciprocated by a mutual electromagnetic force between the outer stators 441, 443, and 445 and the inner stator 448. The permanent magnet 446 may be a single magnet having one polarity, or a plurality of magnets having three polarities.

The permanent magnet 446 may be coupled to the piston 430 by a connection member 438. In detail, the connection member 438 may be coupled to the piston flange 432 and be bent to extend toward the permanent magnet 446. As the permanent magnet 446 is reciprocated, the piston 430 may be reciprocated together with the permanent magnet 446 in the axial direction.

The motor assembly 440 may further include a fixing member 447 to fix the permanent magnet 446 to the connection member 438. The fixing member 447 may be formed of a composition in which a glass fiber or carbon fiber is mixed with a resin. The fixing member 447 may surround an outside of the permanent magnet 446 to firmly maintain a coupled state between the permanent magnet 446 and the connection member 438.

The outer stators 441, 443, and 445 may include coil winding bodies 443 and 445, and a stator core 441. The coil winding bodies 443 and 445 may include a bobbin 443, and a coil 445 wound in a circumferential direction of the bobbin 443. The coil 445 may have a polygonal cross-section, for example, a hexagonal cross-section. The stator core 441 may be manufactured by stacking the plurality of laminations in the circumferential direction and be disposed to surround the coil winding bodies 443 and 445.

A stator cover 449 may be disposed on or at one side of the outer stators 441, 443, and 445. One or a first side of the outer stators 441, 443, and 445 may be supported by the frame 410, and the other or a second side of the outer stators 441, 443, and 445 may be supported by the stator cover 449.

The inner stator 448 may be fixed to a circumference of the cylinder 420. In the inner stator 448, a plurality of laminations may be stacked in a circumferential direction outside of the cylinder 420.

The compressor body 400 may further include a support 437 that supports the piston 430, and a back cover 470 spring-coupled to the support 437. The support 437 may be coupled to the piston flange 432 and the connection member 438 by a predetermined coupling member, for example.

A suction guide 455 may be coupled to a front portion of the back cover 470. The suction guide 455 may guide the refrigerant suctioned in through the suction inlet 100 to introduce the refrigerant into the suction muffler 450.

The compressor body 400 may also include a plurality of springs 476 which are adjustable in natural frequency to allow the piston 430 to perform a resonant motion. The plurality of springs 476 may include a first spring (not shown) supported between the support 437 and the stator cover 449, and a second spring (not shown) supported between the support 437 and the back cover 470.

The one or more body support 500 may support the compressor body 400 within the compressor casing 300. The one or more body support 500 may be disposed on each of both ends of the compressor body 400 in the axial direction of the compressor casing 300. The one or more body support 500 may be mounted on the compressor casing 300 in a direction perpendicular to the axial direction on each of both ends of the compressor body 400.

Each body support 500 may be a plate spring, as illustrated in FIG. 4. When the plate spring is mounted in a direction perpendicular to the axial direction of the compressor body 400, the plate spring may have high transverse rigidity (rigidity with respect to the direction perpendicular to the axial direction of the compressor casing) and low longitudinal rigidity (rigidity with respect to a movement direction of the compressor body) due to characteristics of the plate spring. Thus, the one or more body support 500 according to this embodiment may realize effective vibration insulation, to effectively prevent the compressor casing 300 from colliding with the compressor body 400.

Each body support 500 may include a body coupling hole 502, elastic slits 504, 506, and 508, and one or more interference preventing recess 509. The body coupling hole 502 may couple the body support 500 to the compressor body 400. The body coupling hole 502 may be connected to each of both ends of the compressor body 400. One body support 500 may be mounted on each of both ends of the compressor body 400 through a rubber press-fit process, for example, using a rubber packing member 600 mounted on the body coupling hole 502.

A rotation preventing portion 503 may be disposed in the body coupling hole 502. The rotation preventing portion 503 may have a cross-section having a straight line shape on at least one side (an upper/lower side of the body coupling hole 502 in this embodiment) of the body coupling hole 502. The body support 500 may rotate along the axial direction of the compressor body 400 after being mounted on the compressor body 400. The rotation of the body support 500 may act to restrict the supporting of the compressor body 400. Thus, in this embodiment, undesired rotation of the body support 500 that may occur may be prevented through by the rotation preventing portion 503 having the cross-section with the straight line shape.

The elastic slits 504, 506, and 508 may guide elastic deformation of the body support 500 in the axial direction of the compressor body 400. The elastic slits 504, 506, and 508 may include a first elastic slit 504, a second elastic slit 506, and a third elastic slit 508.

Each of the first to third elastic slits 504, 506, and 508 may have a predetermined length along a circumferential direction of the body support 500, and the first to third elastic slits 504, 506, and 508 may be spaced a predetermined distance from each other. The first to third elastic slits 504, 506, and 508 may be disposed symmetrical to each other with respect to the body coupling hole 502. However, embodiments are not limited thereto. For example, the first to third elastic slits 504, 506, and 508 may have other shapes or arrangements in which the body support 500 is optimally elastically deformable. Further, if the optimized elastic deformation is allowable according to a design thereof, four elastic slits may be provided, or two or less elastic slits may be provided, unlike this embodiment.

A stress reducer 505 to reduce stress concentration may be disposed on each of both ends of the first to third elastic slits 504, 506, and 508. The stress reducer 505 may be provided in a rounded shape to minimize stress concentration that may occur at both ends of each of the elastic slits 504, 506, and 508.

When the compressor body 400 with the body support 500 is mounted, the interference preventing recess 509 may prevent various components of the compressor body 400 from interfering with each other. The interference preventing portion 509 may be disposed on or at an edge of the body support 500. In this embodiment, three interference preventing recess 509 spaced a predetermined distance from each other along the circumferential direction of the body support 500 are provided. This is merely illustrative, and thus, a shape or number of interference preventing recesses 509 may be provided in other shapes or numbers which may prevent various components of the compressor body 400 from interfering with each other according to a design thereof. The interference preventing recess(es) 509 may prevent the body support 500 from rotating, like the rotation preventing portion 503, or perform a function of more firmly mounting the compressor body 400 and the body support 500 according to a design thereof.

As illustrated in FIG. 5, body support 510 may further include a screw coupling portion 514. The screw coupling portion 514 may couple the body support 510 to the compressor body 400 by a screw, for example. The screw coupling portion 514 may be disposed on or at an edge of the body support 510. A plurality of the screw coupling portions 514 may be provided. Hereinafter, in this embodiment, the body support 510 including three screw coupling portions 514 will be described.

The body supports 500 and 510 may be mounted through a rubber press-fit or screw coupling process, for example, when the body supports 500 and 510 are mounted on the compressor body 400. However, embodiments are not limited thereto. For example, the body supports 500 and 510 may be mounted using the above-described coupling process or other coupling processes.

The one or more body support 500 may include a first support 520 and a second support 560. Each of the first and second supports 520 and 560 may be provided as a plate spring.

The first support 520 may be disposed on or at a first side of the compressor body 400. More particularly, the first support 520 may be coupled to the back cover 470 and fixed to an inner wall 322 of the base shell 320. More particularly, the first support 520 may be coupled to the back cover 470 through the rubber packing member 600 mounted on the body coupling hole 502. The first support 520 may have a first end 522 inserted into a support mount 330 disposed in the inner wall 322 of the base shell 320 so that first end 522 may be fitted between the base shell 320 and the first cover 340. The first support 520 may have a second end 524 inserted into the support mount 330 so that the second end 524 may be fitted between the base shell 320 and the first cover 340, like the first end 522.

The second support 560 may be disposed on or at a second end of the compressor body 400. More particularly, the second support 560 may be coupled to the discharge cover 460 and fixed to the inner wall 322 of the base shell 320. More particularly, the second support 560 may be coupled to the discharge cover 460 through the rubber packing member 600 mounted on the body coupling hole 502. The second support 560 may have a first end 562 and a second end 564, which may be inserted into the support mount 330 so that each of the first end 562 and the second end 564 may be fitted between the base shell 320 and the second cover 360.

As described above, the one or more body support 500 according to this embodiment may realize effective vibration insulation and effectively prevent the compressor casing 300 and the compressor body 400 from colliding with each other, which may occur when the compressor operates.

Further, in the one or more body support 500 according to this embodiment, as the one or more body support 500 is not mounted between the inner wall 322 of the base shell 320 of the compressor casing 300 and the compressor body 400 within the compressor casing 300, but rather, is mounted on each of both ends of the compressor body 400 in the direction perpendicular to the axial direction of the compressor casing 300, the distance between the inner wall 322 of the base shell 320 and the compressor body 400 may be minimized.

Thus, in the linear compressor 10 according to this embodiment, the compressor casing 300 may decrease in size to provide a slimmer linear compressor according to trends of slimness.

According to embodiments as described above, a slimmer linear compressor according to trends of slimness and a refrigerator including a linear compressor may be provided.

Embodiments disclosed herein provide a slimmer linear compressor according to trends of slimness and a refrigerator including a linear compressor.

Embodiments disclosed herein provide a linear compressor that may include a compressor casing connected to each of a suction outlet, through which a refrigerant may be introduced, and a discharge outlet, through which the refrigerant may be discharged; a compressor body mounted within the compressor casing, the refrigerant suctioned through the suction inlet being compressed due to a linear reciprocating motion of a piston in an axial direction of the compressor casing and discharged through the discharge out; and a body support disposed on each of both ends of the compressor body in the axial direction. The body support may include a first support member or support disposed on one or a first side of the compressor body, and a second support member or support disposed on the other or a second side of the compressor body. One or a first end of the first support member and one or a first end of the second support member may be mounted on an inner wall of one side of the compressor casing, and the other or a second end of the first support member and the other or a second end of the second support member may be mounted on an inner wall of the other side of the compressor casing.

The compressor casing may include a base shell having a cylindrical shape to accommodate the compressor body; a first cover mounted on one or a first side of the base shell, the first cover being coupled to the suction inlet; and a second cover mounted on the other or a second side of the base shell, the second cover being coupled to the discharge outlet. The first and second support members may be fixed to an inner wall of the base shell.

The first support member may be fitted between the base shell and the first cover. The second support member may be fitted between the base shell and the second cover.

The compressor body may include a back cover disposed to face the suction inlet, and the first support member may be coupled to the back cover. The first support member may be coupled to the back cover through a rubber press-fit or screw process, for example.

The compressor body may include a discharge cover connected to the discharge outlet, and the second support member may be coupled to the discharge cover. The second support member may be coupled to the discharge cover through a rubber press-fit or screw process, for example.

The body support may include a plate spring. A body coupling hole coupled to the compressor body may be defined in the body support, and a rotation prevention part or preventer to prevent the body support from rotating may be disposed in the body coupling hole. At least one elastic slit defined along a circumferential direction of the body support may be defined in the body support.

An interference prevention part or preventer to prevent various parts or components of the compressor body from interfering with each other may be disposed on the body support.

Embodiments disclosed herein may further provide a refrigerator including a linear compressor according to the forgoing embodiments.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:

a compressor casing having a central longitudinal axis extending in a horizontal direction and connected to each of a suction inlet, through which a refrigerant is introduced into the linear compressor, and a discharge outlet, through which the refrigerant is discharged from the linear compressor;

a compressor body disposed within the compressor casing to compress the refrigerant suctioned through the suction inlet and to discharge the compressed refrigerant to the discharge outlet, the compressor body including:

a cylinder having a compression space;

a piston that linearly reciprocates to compress the refrigerant in the compression space; and a motor assembly connected to the piston to drive the piston in a linear reciprocating motion;

a back cover disposed adjacent to the suction inlet, the back cover including an opening that provides fluid communication between the suction inlet and the compressor body;

a discharge cover disposed adjacent to the discharge outlet; and a plurality of body supports to support the compressor body within the compressor casing, and comprising:

a first plate spring coupled to a first end of a base shell of the compressor casing; and a second plate spring coupled to a second end of the base shell, wherein the compressor casing comprises:

the base shell having a cylindrical shape to accommodate the compressor body;

a first cover mounted on a first end of the base shell, the first cover being coupled to the suction inlet; and a second cover mounted on a second end of the base shell, the second cover being coupled to the discharge outlet, wherein an edge of the first plate spring is disposed in a first step formed on an inner wall of the base shell at the first end of the base shell, wherein an end of the first cover is also disposed in the first step so as to be coupled to the base shell and is further coupled to and supports the back cover, wherein an edge of the second plate spring is disposed in a second step formed at an inner wall of the base shell at the second end of the base shell, wherein an end of the second cover is also disposed in the second step, so as to be coupled to the base shell and is further coupled to and supports the discharge cover, wherein each of the first and second plate springs includes:

a plurality of elastic slits roundedly formed along a circumferential direction; and a pair of stress reducers on both ends, respectively, of each of the slits to reduce stress concentration, wherein each of the pair of stress reducers is rounded to further protrude in a radial direction of the plate spring, wherein each of the plurality of elastic slits extends to turn more than 360°, and wherein the first and second plate springs provide high transverse rigidity in a direction perpendicular to an axial direction of the compressor casing and low longitudinal rigidity in the axial direction and movement direction of the compressor body to prevent the compressor casing from colliding with the compressor body.

2. The linear compressor of claim 1, wherein each of the first and second plate springs comprises a body coupling groove defined therein and configured to be coupled to the back cover and the discharge cover, respectively, and wherein a rotation preventer to prevent the plate spring from rotating is provided in the body coupling groove.

3. The linear compressor of claim 2, wherein each of the first and second plate springs further comprises a screw coupling portion formed at an edge thereof.

4. The linear compressor of claim 2, wherein each of the first and second plate springs comprises at least one interference preventer to prevent various portions of the compressor body from interfering with each other.

5. The linear compressor of claim 1, further comprising a rubber packing member mounted on the body coupling groove of the first plate spring, wherein the first plate spring is coupled to the back cover by the rubber packing member.

6. The linear compressor of claim 1, further comprising a rubber packing member mounted on the body coupling groove of the second plate spring, wherein the second plate spring is coupled to the discharge cover by the rubber packing member.

* * * * *